US007047683B2

(12) United States Patent
Austin

(10) Patent No.: US 7,047,683 B2
(45) Date of Patent: May 23, 2006

(54) ALBUM FORMED FROM FOLDED PHOTOGRAPHIC PRINTS

(76) Inventor: Curtiss Mitchell Austin, 439 Branch Hill-Loveland Rd., Loveland, OH (US) 45140

( * ) Notice: Subject to any disclaimer, the term of this patent is extended or adjusted under 35 U.S.C. 154(b) by 132 days.

(21) Appl. No.: 10/727,967

(22) Filed: Dec. 4, 2003

(65) Prior Publication Data

US 2005/0120607 A1 Jun. 9, 2005

(51) Int. Cl.
*A47G 1/06* (2006.01)

(52) U.S. Cl. ..... 40/700; 40/773; 281/21.1

(58) Field of Classification Search ..... 40/700, 40/773; 281/21.1, 22, 34, 38, 15.1, 29, 3.1; 153/908; 283/61; 412/1, 6, 8, 7, 33
See application file for complete search history.

(56) References Cited

U.S. PATENT DOCUMENTS

| | | | | |
|---|---|---|---|---|
| 5,011,187 | A * | 4/1991 | Hunder et al. | 281/15.1 |
| 5,033,964 | A * | 7/1991 | Phelps | 434/113 |
| 5,702,219 | A * | 12/1997 | Hattori | 412/6 |
| 6,276,887 | B1 * | 8/2001 | Hughes | 412/1 |
| 2002/0168248 | A1 * | 11/2002 | Ertel et al. | 412/8 |
| 2003/0075917 | A1 * | 4/2003 | Frosig et al. | 281/21.1 |
| 2005/0116461 | A1 * | 6/2005 | Katz et al. | 281/21.1 |

* cited by examiner

*Primary Examiner*—Gary C. Hoge

(57) ABSTRACT

An album manufactured solely of folded photographic prints bonded together plus a treatment applied to the spine. Two-page spreads are imprinted on each print except the first and last pages, which are placed on the right and left halves of the first and last prints, respectively. When made from standard photographic print sizes, the album achieves the valuable objectives of low cost, low weight and low bulk, and are especially suited for secondary copies of full-size composite image flush mount albums.

3 Claims, 2 Drawing Sheets

ALBUM FORMED FROM FOLDED PHOTOGRAPHIC PRINTS

CROSS-REFERENCE TO RELATED APPLICATIONS

Not applicable

FEDERALLY-SPONSORED RESEARCH

Not applicable

SEQUENCE LISTING OR PROGRAM

Not applicable

BACKGROUND OF THE INVENTION

1. Field of Invention

This invention relates to albums that are formed directly from photographic prints by folding, bonding and finishing operations.

2. Background of the Invention

A long-standing inconvenience in the production of photographic albums arises from the difficulty in producing two-sided prints. For example, photographic print paper has emulsion on only one side. Other means of printing, such as inkjet printing, is also largely restricted to paper with only one side suitable for printing; when two-sided paper is available, it becomes a challenge to produce prints with the proper degree of registration between front and back images. Thus, most albums made up of two-sided pages are assembled from individual one-sided prints placed on either side of an album leaf.

Another common inconvenience has been that photographic images are printed on discrete pieces of paper of various sizes that must be mounted or otherwise affixed to specific album components. These albums include the "assembled" type, consisting of a cover, inserts and mattes in which photographs are inserted individually, and the "mounted" type, in which prints and mattes are adhesively combined and mounted on leaves which are bound together with a cover. Another type of album, less popular until recently, is the "flush" type, in which single sheets are bonded to leaves without mattes—the prints extend to the edge of the page, i.e., flush to the edges.

The emergence of digital photographic techniques has changed this situation somewhat—it is now easy to combine multiple images that can be printed on single sheets and mounted in a flush type album. This type of album will be referred to as the "composite image flush" type. Good album design generally favors an approach whereby two-page spreads are designed, that is, computer image files are created that combine left and right pages on either side of the album gutter.

A growing number of photographers are designing composite image flush albums. Currently, the photographer produces prints that are then provided to album manufacturers, who then fabricate leaf assemblies, which are then bound to one another and to front and back covers. These albums are relatively expensive. In most situations, a photographer will produce just one copy, for the client's personal use. This is an undesirable situation, since the client would likely wish to provide copies to others, and the photographer himself or herself would wish additional copies for documentation or marketing purposes. Furthermore, these albums are large and heavy, and therefore reach a limited audience to the detriment of both the client and the photographer. A more easily transported form of album can be viewed more often and shown to more people.

Conventional album manufacturers offer small versions of their full-size albums, but utilize the same materials and processes; hence, they remain somewhat expensive since material cost is only somewhat reduced and labor cost is nearly the same given the same number of components and process steps. Furthermore, these albums retain a certain bulk and weight owing to their construction, which involves inserts, covers and elaborate hinge and binding schemes.

BACKGROUND OF THE INVENTION—OBJECTS AND ADVANTAGES

Accordingly, the present invention stems from a need for a low-cost and easily transported version of these sorts of new photographic albums.

The principle form of the invention involves printing two-page spreads (left and right pages together) on one-sided photographic paper, folding them inwardly at the gutter, adhesively bonding the folded subassemblies (the back of a right-hand page to the back of the left-hand page of the next folded sub-assembly), and conducting such finishing operations as required to result in a trimmed, finished appearance, generally including the application of tape to conceal and strengthen the folded edges (spine) of the album.

In its principle form, the album achieves a near-theoretical minimization of bulk and weight, being comprised solely of photographic prints plus a small quantity of adhesive and finishing material. It solves the one-sided print problem with the theoretical minimum construction—bonding prints back-to-back. It also provides the theoretical minimum bound hinge requirement by using no hinges other than the folds formed in the prints themselves. When produced from standard-sized prints (e.g., four by six inches), material cost is also minimized. Altogether, it should be apparent that material cost, bulk and weight of an album produced in this manner are simultaneously and uniquely minimized by this invention.

Modified forms exist that do not substantially depart from the object of this invention, such as inclusion of material to form more substantial cover leaves or stiffer pages, as may be desirable for larger sizes.

SUMMARY

A photographic album produced entirely from photographic prints that are folded and bonded to one another, back-to-back, plus a simple spine finishing treatment. Each print becomes a two-page spread. Each leaf is two-sided. In its most exemplary form, a very low cost of production is achieved.

DRAWINGS—FIGURES

DRAWINGS—REFERENCE NUMERALS

Figure 1:
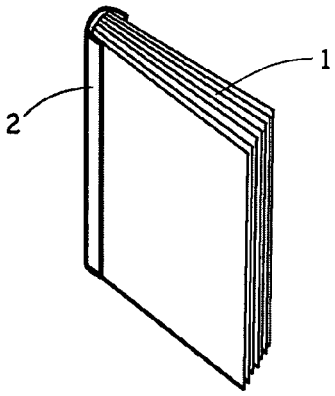
FIG. 1 shows an assembled album consisting of folded prints, self-formed hinges and tape that covers the spine.
Figure 2:
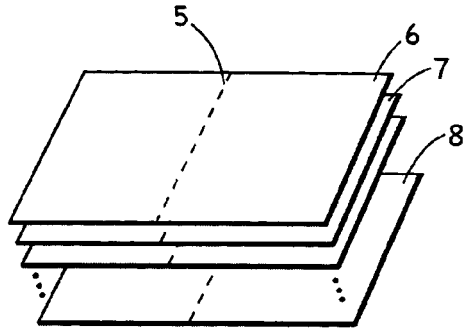
FIG. 2 shows an array of starting prints, each consisting of the left and right side pages of full two-page spreads, except for the first and last print, which include the first and last pages only.
Figure 3:
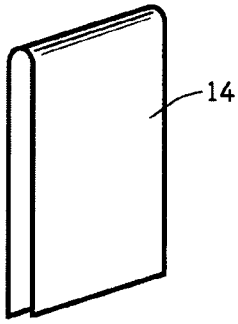
FIG. 3 shows a subassembly consisting of an inwardly folded print.
Figure 4:
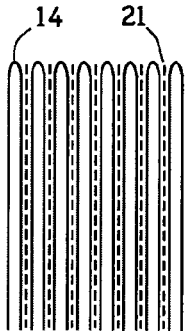
FIG. 4 shows a collection of subassemblies prior to the bonding stage.

1 Album pages
2 Spine covering and reinforcement
5 fold location
6 First print prior to folding; left side is blank and is subsequently removed
7 Second and successive prints prior to folding
8 Last print prior to folding; right side is blank and is subsequently removed
14 Folded print subassembly
21 Adhesive placed on or between subassemblies
27 Left side of first print, removed subsequently
28 Right side of last print, removed subsequently
32 Trim lines
35 Image area
41 Stiffening panels of an alternative embodiment
52 Area that may be bonded in order to stabilize subassemblies
61 Temporary pleated article
63 Adhesive tape used to join subassemblies
70 Strip imprinted with sequence of images
71 Inward fold
72 Outward fold
74 Sacrificial panels placed on either side of bonded pages

DETAILED DESCRIPTION—FIGS. 1, 2, 3, 4, 5, AND 6

A preferred embodiment of the album of the present invention is shown in FIG. 1. The pages 1 are comprised of single-sided prints that have been folded and bonded back-to-back in a manner that forms two-sided pages and the hinges that connect them together. Material 2 is added to the spine/hinge area to hide the folds and/or reinforce the hinges formed by the folds. In the preferred embodiment, this material is self-adhesive cloth binding tape.

The construction and assembly process is elaborated upon in FIGS. 2 through 5. Prints 6–8 are prepared by conventional photographic means, including optical processes but more likely digital printers including those based on light emitting diodes, lasers, inkjets and dye sublimation methods. The image corresponding to the front cover (page 1) of an album is placed on the right half of the first print. Subsequent images are imprinted on the prints in an arrangement based on two-page spreads. That is, page 2 of an album is imprinted on the left half of the second print, while page 3 is imprinted on the right half of the second print. These placements would typically be made by use of computer image manipulation techniques, but this is not necessary—for example, an album might be formed by single photographs that extend across opposite pages, making up full-spread images. Pages 4 and 5 and all successive pages would be arranged similarly, until the back cover (the last page), which is imprinted on the left side of the last print. The blank halves of the first and last print are trimmed off at a later time.

Each print is folded inwardly to form subassemblies 14 such that the image sides are in contact and the blank back sides of the prints are exposed. Adhesive material 21 is placed on or between mating subassemblies surfaces, such as by spraying liquid adhesive to one or both sides, or by placement of solid adhesive or fusible material between mating subassemblies. These subassemblies and adhesive material are brought into contact in a fashion that simultaneously forms two-sided pages 1 and hinges between each of these formed pages.

Figure 5:
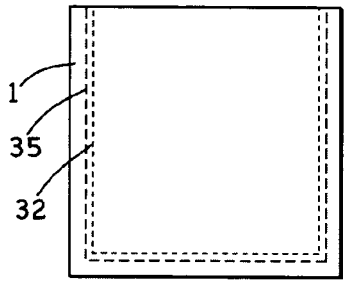
FIG. 5 shows an optional trimming operation.
Figure 6:
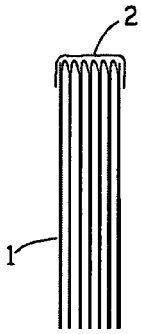
FIG. 6 shows a completed album viewed from above the top edge, including the preferred form of finishing the spine.

The three non-hinge edges are optionally trimmed and finished to conform to the size of the imprinted images along trim lines 32 located within the image area 35 as shown in FIG. 5. The blank halves of the first 27 and last 28 prints are then cut away along the folds. FIG. 6 shows a top-edge-wise view of a completed album after application of tape 2 along the spine.

FIGS. 7 through 12—Additional Embodiments

Figure 7:
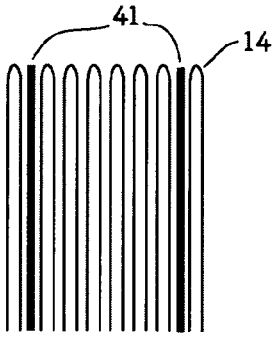
FIG. 7 shows the optional inclusion of stiffening panels between the first and second prints, and between the penultimate and last prints, forming thickened front and back covers.
Figure 8:
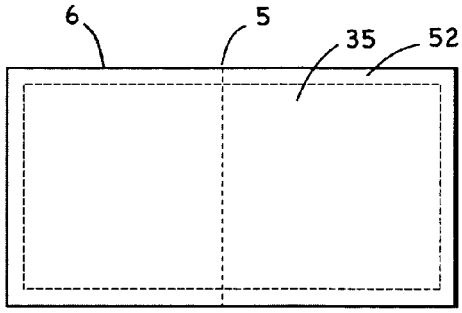
FIG. 8 shows the optional step of stabilizing the configuration of subassemblies.

Material that can function to stiffen and/or thicken all or selected pages may be placed along with adhesive material between prints. An example is shown in FIG. 7 where such material 41 is placed between the first and second prints and also between the penultimate and last prints, thereby forming thickened and/or stiffened front and back cover pages.

For convenience in subsequent handling, non-image areas 52 of the image side of prints may be bonded together, face-to-face, to stabilize their configuration prior to the joining of subassemblies to each other, the major object being to keep them flat to facilitate handling. Various bonding means may be employed, such as adhesive bonding or autogenous welding in the case of resin-coated print paper, such welding may be accomplished by various means employing the temporary application of heat including spot processes (tack welding), roll processes (hot roll welding) or area processes (hot plate welding). Bonded areas are removed during the trimming operation as shown in FIG. 5.

Figure 9:
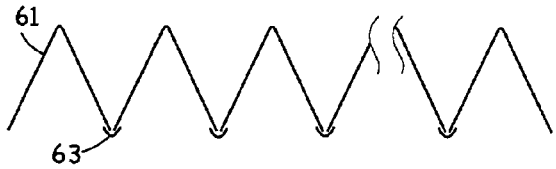
FIG. 9 shows an alternative assembly method in which a temporary pleated article is formed.

An alternative assembly process is shown in FIG. 9 in which prints are partially folded into a V shape 61. The free ends are joined together 63 with adhesive tape or other temporary means to form a temporary article having the zigzag appearance of pleated fabric. Adhesive is applied on the back, non-image side of the pleated article, at which point the entire article may be compressed in one step to form a bonded assembly of prints.

Figure 10:
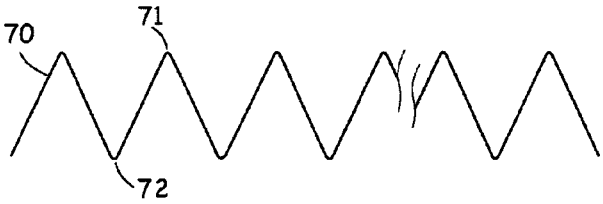
FIG. 10 shows an alternative method of forming a temporary pleated article.

The temporary pleated article may be formed more directly as shown in FIG. 10 by imprinted images on a strip of paper 70, which is then folded in alternate inwards 71 and outwards 72 directions to form the same pleated configuration.

Figure 11:
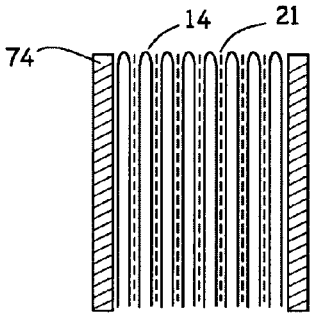
FIG. 11 shows the use of sacrificial panels.

Processing may be facilitated by use of sacrificial panels 74 placed on top and bottom of the print assembly as shown in FIG. 11. Such panels protect the assembly from compression forces and provide support to the edges during trimming and finishing. The panels are removed after edge finishing and before application of material to the spine.

Figure 12:
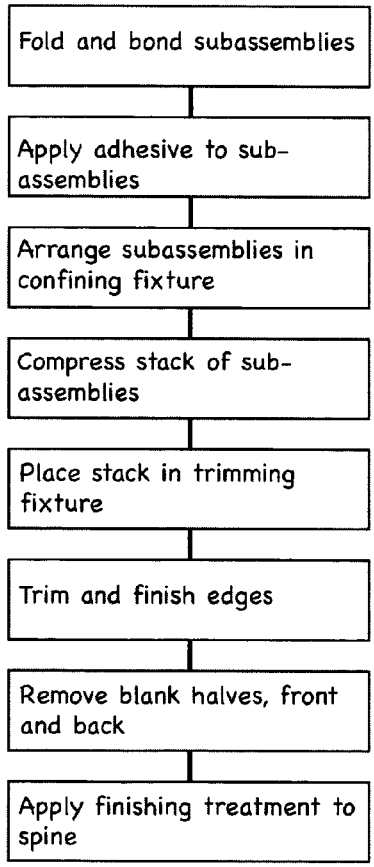
FIG. 12 shows a detailed assembly sequence and associated fixtures.

A detailed sequence of processing steps is depicted in FIG. 12. Prints are placed in sequence on a fixture. The central longitudinal portion is covered with a mask and adhesive is sprayed in the non-image areas at the top and bottom of each print. Prints are then folded, stabilized by the bonds formed at the top and bottom areas. All the subassemblies except the first are placed in sequence on another fixture where one side is sprayed with adhesive. The first assembly is placed in a box slightly larger than the subassembly. The second subassembly is placed in the box in contact with the first, the box imposing proper alignment. Succeeding subassemblies are similarly placed. The bonded assembly is removed and placed between sacrificial panels, and pressed between platens to establish full bonding and achieve adequate flatness. The pressed assemblies are transferred to a fixture that facilitates accurate trimming. After smoothing the trimmed edges, the sacrificial panels are removed, the blank print halves removed, and the spine treatment is applied.

Accordingly, the reader will see that this form of photographic album and the process by which it is made uniquely achieves a number of objectives, including low cost of production, small size and small weight. In combination, the album provides advantages to the consumer of photographic services, including the ability to purchase additional copies of full-size albums at small cost, and easy transport. Similar advantages are offered to the photographer, who may acquire archival copies of his or her album designs, more readily show his or her work to potential clients, and distribute low-cost copies for advertising purposes.

Although the description above contains many specificities, these should not be construed as limiting the scope of the invention but as merely providing illustrations of some of the presently preferred embodiments of this invention. For example, while small size is a feature of the preferred embodiment, there are advantages of this form of album even when produced at larger sizes. More elaborate finishing treatments are obvious variations, such as the use of alternative materials, or combinations with other articles, such as bookcovers, bookcases, and cloth sacks. Thus, the scope of the invention should be determined by the appended claims and their legal equivalents, rather than by the examples given.

I claim:

1. A method of making an album from photographic prints comprising the steps of:

providing a plurality of photographic prints;

folding each print inwardly so as to create from each print a sub-assembly having two pages facing each other;

bonding adjacent sub-assemblies back-to-back so as to form an album having a spine, a first page, a last page, and a plurality of intermediate pages;

trimming excess material from top, side and bottom edges of said pages;

removing said first page and said last page;

attaching a binding to said spine of said album.

2. The method of claim 1, further comprising the step of stabilizing said sub-assemblies by bonding their pages together in sacrificial areas along their edges.

3. The method of claim 1, further comprising the steps of fixing said album between sacrificial panels before said trimming step;

removing said sacrificial panels after said trimming step.

* * * * *